United States Patent [19]

Günnewig

[11] Patent Number: 4,498,897

[45] Date of Patent: Feb. 12, 1985

[54] CENTRIFUGE WITH A SELF-EMPTYING DRUM

[75] Inventor: Hübert Günnewig, Oelde, Fed. Rep. of Germany

[73] Assignee: Westfalia Separator AG, Oelde, Fed. Rep. of Germany

[21] Appl. No.: 546,126

[22] Filed: Oct. 27, 1983

[30] Foreign Application Priority Data

Oct. 29, 1982 [DE] Fed. Rep. of Germany ..... 3240093

[51] Int. Cl.[3] ..... B04B 11/02

[52] U.S. Cl. ..... 494/27; 494/40

[58] Field of Search ..... 494/1, 2, 4, 23, 25, 494/26, 27, 29, 30, 40, 48, 56

[56] References Cited

U.S. PATENT DOCUMENTS

| | | | |
|---|---|---|---|
| 4,083,488 | 4/1978 | Gunnewig | 494/27 |
| 4,151,951 | 5/1979 | Kohlstette | 494/30 |
| 4,410,319 | 10/1983 | Zettier et al. | 494/29 |

*Primary Examiner*—Robert W. Jenkins
*Assistant Examiner*—Arthur D. Dahlberg
*Attorney, Agent, or Firm*—Sprung, Horn, Kramer & Woods

[57] ABSTRACT

A centrifuge with a self-emptying drum including drum jacket having ejection openings for the solids that collect in the solids space. The openings can be blocked off with a piston valve with which is associated a closure compartment that can be charged with closure liquid. The closure compartment has outlet channels around it that can be blocked off with a hydraulically controlled valve body. When the valve is open, the closure liquid flows into a compartment with choked run-off bores. The compartment has sufficient capacity for part of the closure liquid. The compartment has at least one run-off channel that has a valve with a piston that can be shifted hydraulically in it. When the solids space is to be completely emptied, the closure liquid flowing into the compartment moves the valve piston into the opening position so that the closure liquid can flow off through a channel. If the solids space is only to be partly emptied, the valve piston is retained in the sealing position, in which it is charged with pressure liquid on the side facing away from the compartment.

8 Claims, 3 Drawing Figures

CENTRIFUGE WITH A SELF-EMPTYING DRUM

BACKGROUND OF THE INVENTION

The present invention relates to a centrifuge with a self-emptying drum of the type disclosed in copending U.S. patent application No. 471,419 filed Mar. 2, 1983, with ejection or expulsion openings in the drum jacket that lead out of the solids space and that can be blocked off with a piston valve which is associated with a closure compartment or chamber that can be charged with closure liquid and that has outlet channels around it that can be blocked off with a hydraulically controlled valve and through which the closure liquid can be introduced, when the valve is open, into a blocking compartment or chamber with choked run-off bores. The control compartments that are associated with the valve body are separated liquid-tightly from the compartment into which the outlet channels empty and the compartment has sufficient capacity for part of the closure liquid accepted by the closure compartment.

The disadvantage of the centrifuge disclosed in the aforementioned copending U.S. patent application is that it can be only partly emptied.

SUMMARY OF THE INVENTION

The object of the present invention is a substantially improvement in the centrifuge of the copending U.S. patent application that also includes simple means of completely emptying the solids space.

This object is achieved in accordance with the invention by providing the compartment with at least one run-off channel that has a valve with a piston that can be shifted hydraulically in it.

The solids space of the centrifuge can be partly emptied when the valve piston is in the closure position.

The solids space can also be completely emptied when the valve piston is in the opening position.

In one practical embodiment of the invention, one or more valve pistons have a calibrated channel that extends axially over their total length and through which control water can be introduced into the compartment.

This varies the volume of closure liquid taken up by the compartment, affecting the portion that escapes from the solids space when the piston valve opens.

The centrifuge in accordance with the invention accordingly makes it possible to either completely empty the solids space or partly empty it to an extent that corresponds to the volume taken up by the specially designed compartment as well as to determine the portions to be emptied by introducing control water into the compartment.

Further features and characteristics of the invention include the preferred embodiment wherein the the overall cross-section of the run-off channels is equal to or greater than the total cross-section of the outlet channels leading from the closure compartment to the compartment. In one embodiment, the longitudinal axis of the valve piston preferably parallels the axis of rotation of the drum, and in another embodiment the longitudinal axis of the valve piston extends radially to the axis of rotation of the drum. Further, the valve piston preferably can be shifted into the opening position by supplying control water and into the sealing position by centrifugal force.

Some preferred embodiments of the invention will now be described with reference to the attached drawings, wherein

DETAILED DESCRIPTION OF THE PREFERRED EMBODIMENTS

Figure 1:
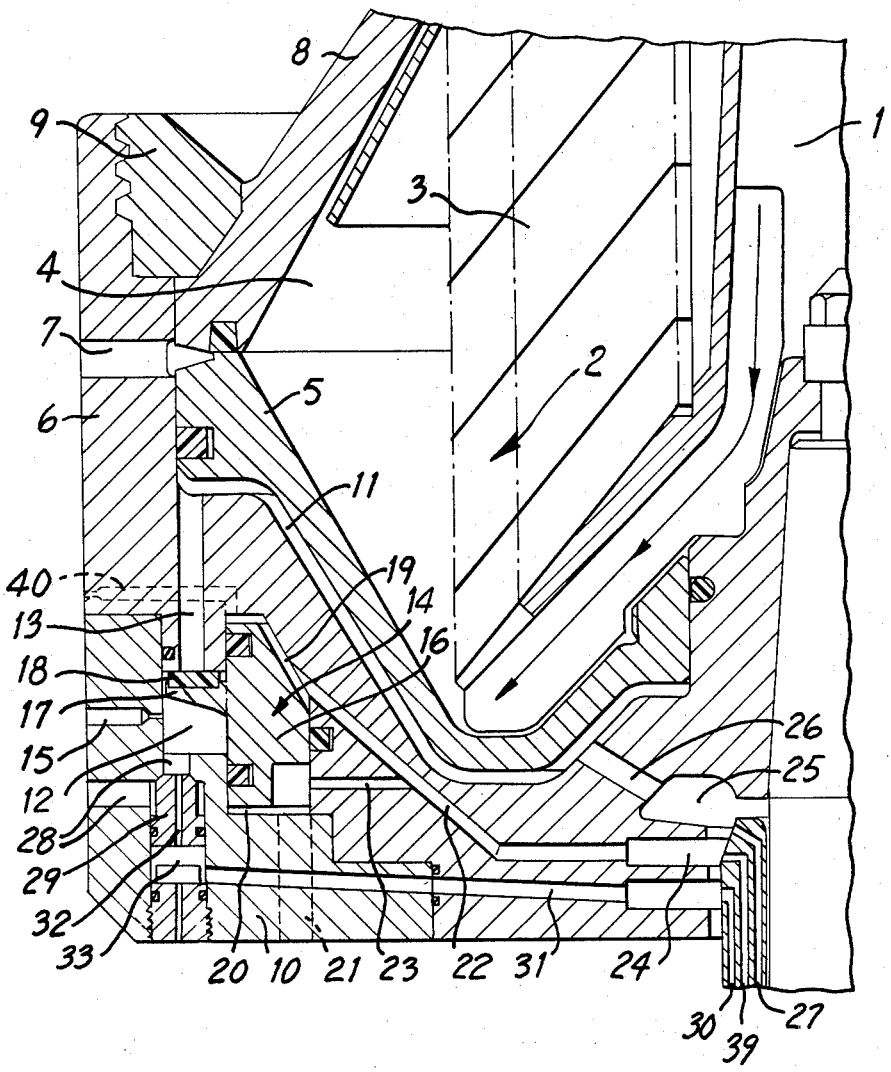
FIGS. 1-3 are details of vertical sections through various embodiments of the centrifuge in accordance with the invention.

Referring now to FIG. 1, a mixture of solids and liquid is conveyed through a central intake 1 to a centrifuge space 2 that consists of a separation space 3 and a solids space 4. Solids space 4 is bounded on one side by a piston valve 5 that moves axially to block off or release solids-ejection openings 7 in the jacket 6 of the drum.

The drum also has, first, a cover 8 that is attached to drum jacket 6 with a sealing ring 9 and, second, a guide ring 10 that is attached to the bottom with screws.

Between piston valve 5 and drum jacket 6 or the bottom of the drum is a closure compartment 11 that can be charged with closure liquid and that has outlet channels 13 around it that lead to a compartment 12 and can be blocked off by a hydraulically controlled valve body 14. Compartment 12 has choked outlet bores 15. Valve body 14 has an annular piston 16 from which cam-like brackets 17 extend into compartment 12. Each bracket 17 supports a seal plate 18 that can block off the bottom opening of an outlet channel 13 in a liquid-tight manner.

Figure 2:
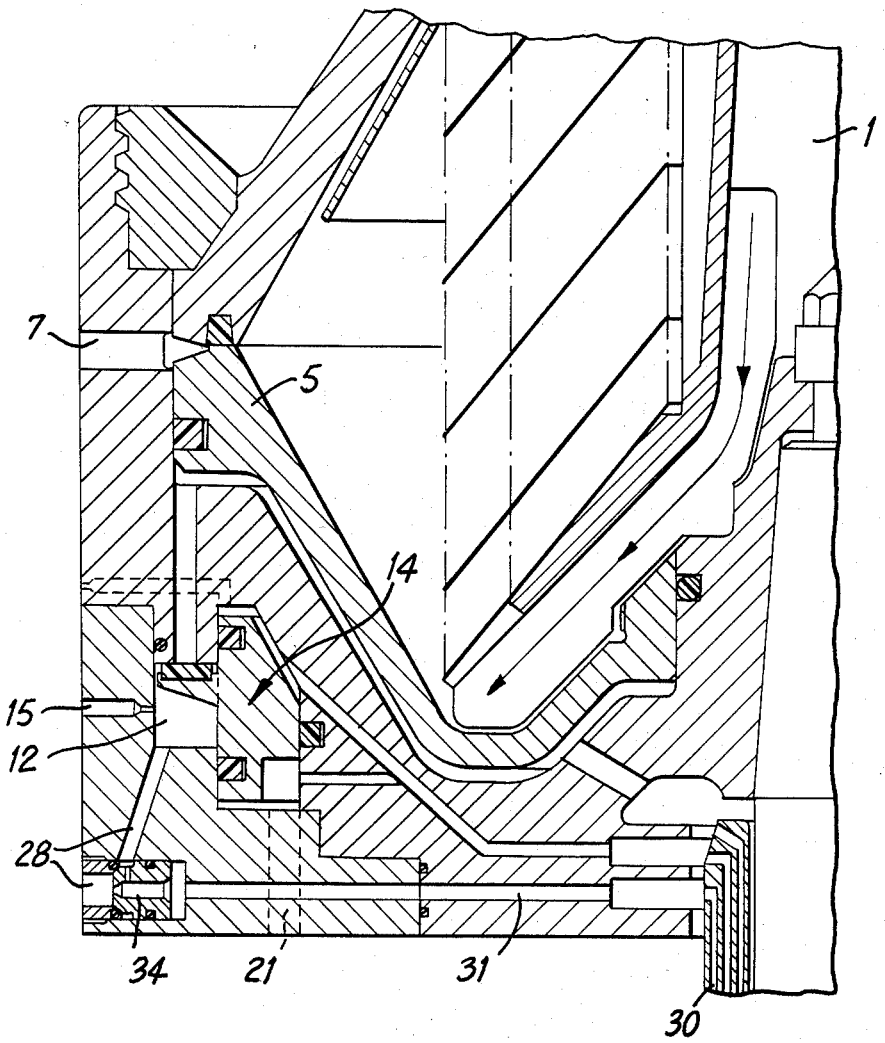
Figure 3:
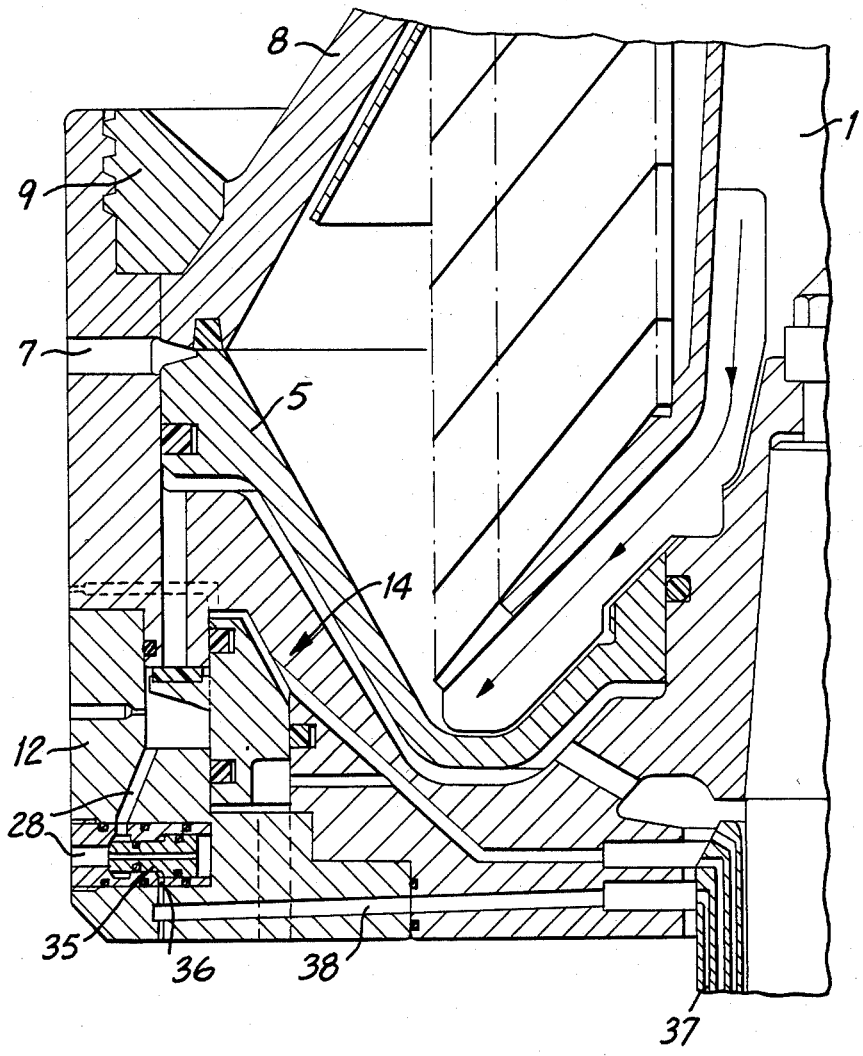

It will be evident from FIGS. 1-3, that the annular piston 16 of valve body 14 constitutes the total inside surface of compartment 12. Control compartments 19 and 20, which are separated liquid-tightly from compartment 12, are associated with valve body 14. An overflow channel 21 empties into control compartment 20. Control compartments 19 and 20 are supplied with liquid through channels 22 and 23. Channels 22 terminate in a gutter 24. Another gutter 25 communicates through channels 26 with closure compartment 11.

Valve body 14 is brought into the sealing position before intake 1 is opened for the mixture of solids and liquids that is to be separated. Closure compartment 11 is then charged with closure liquid through bore 27, gutter 25, and channels 26. The closure liquid displaces piston valve 5 into the closure position as shown.

In the embodiment illustrated in FIG. 1 compartment 12 has at least one run-off channel 28 that has a valve in it with a hydraulically displaceable valve piston 29.

This valve in positioned in guide ring 10 below compartment 12. The longitudinal axis of valve piston 29 parallels the axis of rotation of the drum.

Valve piston 29 can be shifted into the opening position by charging compartment 12 with the closure fluid. Control water supplied through channels 30 and 31 displaces valve piston 29 into the sealing position illustrated in FIG. 1.

Valve piston 29 has a calibrated channel 32 that extends axially over its total length, that connects lower control compartment 33 to compartment 12, and through which control water can be introduced into the compartment 12 to reduce its capacity for closure liquid.

In embodiments in which several run-off channels 28 and several valve pistons 29 are associated with compartment 12, one or more of the pistons can have a calibrated channel 32.

When the solids space is to be completely emptied, control compartment 33 is not charged with control water and valve piston 29 is shifted into the opening position by closure liquid flowing into compartment 12, releasing run-off channel 28. An appropriate number of appropriately dimensioned valve pistons and run-off valves will prevent pressure from building up in compartment 12 so that all the closure liquid will be released from closure compartment 11.

It is practical for the overall cross-section of run-off channels 28 to be equal to or greater than the total cross-section of the outlet channels 13 leading from closure compartment 11 to compartment 12.

The longitudinal axis of the valve piston 34 in the embodiment illustrated in FIG. 2 extends radially to the axis of rotation of the drum. Valve piston 34 must be light enough and mounted in such a way that it can be shifted into the opening position by the closure liquid flowing of of compartment 12. Control water is supplied through channels 30 and 31 to bring valve piston 34 into the sealing position illustrated in FIG. 2. The valve piston 35 in the embodiment illustrated in FIG. 3 is positioned so that its longitudinal axis extends radially to the axis of rotation of the drum. Valve piston 35 is retained in the sealing position by the centrifugal force generated by the rotation of the drum. When the solids space is to be emptied completely, the control compartment 36 associated with valve piston 35 is charged with control water through channels 37 and 38 and valve piston 35 shifted into the opening position.

Solids space 4 can be emptied partly or completely once a specific amount of solids has accumulated in it. To initiate the emptying process, control liquid is conducted through bores 39, gutter 24, and channels 22 and 23 into the control compartments 19 and 20 in valve body 14. Since the liquid pressure in control compartment 19 is essentially higher than that in control compartment 20, valve body 14 will shift into the opening position so that the closure liquid, which is subject to centrifugal force, will flow out of closure compartment 11 through outlet channels 13 into compartment 12 in a fraction of a second. When valve pistons 29, 34, and 35 are retained in the sealing position to produce partial emptying, the closure liquid taken up by compartment 12 acts, once the chamber is full, like a blocking liquid for outlet channels 13, so that piston valve 5 is shifted into the sealing position as soon as the pressure in centrifuge space 2 drops as a result of the amount of solids extracted to the extent that the force generated in closure compartment 11 by the remaining closure fluid will prevail. Continued supply of closure liquid will return the liquid pressure in the closure compartment to its full level very rapidly, retaining piston valve 5 in the sealing position.

Since the intake for the mixture of solids and liquid that is to be separated remains open during partial emptying, the pressure in separation space 3 and solids space 4, which has fallen during partial emptying, will increase again once ejection openings 7 have been sealed off.

Upon termination of partial emptying, interruption of the supply of control liquid through bores 39 and channels 22 into control compartment 19 will reduce the liquid pressure in the compartment, from which the control liquid can flow through choke bores 40. Since the liquid pressure in control compartment 20 will prevail, valve body 14 will shift into the sealing position and assume the function of blocking liquid.

When the solids space is to be completely emptied, valve pistons 29, 34, and 35 are shifted into the opening position, so that all the closure liquid supplied to compartment 12 can run off through channels 28.

It will be appreciated that the instant specification and claims are set forth by way of illustration and not limitation, and that various modifications and changes may be made without departing from the spirit and scope of the present invention.

What is claimed is:

1. In a centrifuge having a self-emptying drum with ejection openings which are opened and closed by a piston valve movable in a response to pressure from closure fluid in a closure compartment having outlet channels therearound which are opened and closed by a hydraulically controlled valve body having control compartments and a first compartment fluid-tightly separated from the control compartments and into which the outlet channels communicate when opened by the valve body, the first compartment having choked outlets and configured to accommodate a part of the closure fluid from the closure compartment, the improvement comprising: means forming at least one run-off channel in fluid communication with the first compartment and fluid actuated valve means for blocking and unblocking the run-off channel to effect the complete emptying when the run-off channel is unblocked.

2. The centrifuge as in claim 1, further comprising a guide ring below the first compartment and wherein the valve means is mounted in the guide ring.

3. The centrifuge as in claim 1, wherein the valve means includes a piston which is movable into a unblocking position by charging the first compartment with closure liquid.

4. The centrifuge as in claim 1, wherein the valve means includes at least one valve piston disposed between the first compartment and a control compartment and having a calibrated channel that extends axially over the total length of the valve piston and that connects control compartment to the first compartment and through which control fluid can be introduced into the first compartment.

5. The centrifuge as in claim 1, wherein the the overall cross-section of said at least one run-off channel is not less than the total cross-section of the outlet channels leading from the closure compartment to the first compartment.

6. The centrifuge as in claim 1, wherein the valve means comprises a valve piston and the longitudinal axis of the valve piston parallels the axis of rotation of the drum.

7. The centrifuge as in claim 1, wherein the valve means comprises a a valve piston and the longitudinal axis of the valve piston extends radially to the axis of rotation of the drum.

8. The centrifuge as in claim 1, wherein the valve means comprises a valve piston which is movable into a blocking position by centrifugal force and into an unblocking position in response to the supply of a control fluid.

* * * * *